US005842247A

United States Patent [19]

Decesare

[11] Patent Number: 5,842,247

[45] Date of Patent: Dec. 1, 1998

[54] COMBINATION TOOTHBRUSH AND TONGUE BRUSH

[76] Inventor: Angela T. Decesare, 100 Rockledge Rd., Bronxville, N.Y. 10708

[21] Appl. No.: 871,253

[22] Filed: Jun. 9, 1997

[51] Int. Cl.[6] ..... A46B 9/04

[52] U.S. Cl. ..... 15/106; 15/167.1; D4/105

[58] Field of Search ..... 15/106, 167.1, 15/107, 111, 167.2; D4/104, 105, 106–113, 119; 601/141, 139, 136, 137; 132/309

[56] References Cited

U.S. PATENT DOCUMENTS

| | | | |
|---|---|---|---|
| D. 284,528 | 7/1986 | Jurado | D4/105 |
| D. 295,695 | 5/1988 | Golzari | D4/105 |
| D. 357,121 | 4/1995 | Fuentes et al. | D4/104 |
| D. 375,206 | 11/1996 | Halm | D4/104 |
| 2,668,308 | 2/1954 | Grossman | 15/106 |
| 4,670,931 | 6/1987 | Abbassi | 15/106 |
| 4,763,375 | 8/1988 | Vieten | 15/106 |
| 5,522,109 | 6/1996 | Chan | 15/106 |

FOREIGN PATENT DOCUMENTS

| | | | |
|---|---|---|---|
| 652626 | 10/1928 | France . | |
| 1144556 | 4/1957 | France | 15/106 |
| 574224 | 4/1976 | Switzerland | 15/106 |
| 3816 | 1/1873 | United Kingdom | 15/167.1 |
| 9487 | 5/1896 | United Kingdom | 15/106 |
| 24166 | 10/1906 | United Kingdom | 15/106 |

*Primary Examiner*—Gary K. Graham

[57] ABSTRACT

A combination toothbrush and tongue brush including a main body portion. A toothbrush portion extends linearly from a first end of the main body portion. The toothbrush portion has a plurality of long bristles extending orthogonally therefrom. A tongue brush portion extends from a second end of the main body portion. The tongue brush portion has a plurality of short bristles extending outwardly therefrom.

1 Claim, 2 Drawing Sheets

COMBINATION TOOTHBRUSH AND TONGUE BRUSH

BACKGROUND OF THE INVENTION

1. Field of the Invention

The present invention relates to a combination toothbrush and tongue brush and more particularly pertains to allowing a person to brush their teeth and their tongue without gagging with a combination toothbrush and tongue brush.

2. Description of the Prior Art

The use of toothbrushes is known in the prior art. More specifically, toothbrushes heretofore devised and utilized for the purpose of cleaning and brushing teeth and gums are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,455,704 to Williams discloses a toothbrush and tongue cleaner. U.S. Pat. No. 5,065,470 to Diamond discloses a toothbrush. U.S. Pat. No. 4,763,375 to Vieten discloses a toothbrush. U.S. Pat. No. Des. 332,354 to Fitzgibbon discloses the ornamental design for a portable mirror with rear suction support. U.S. Pat. No. 5,331,704 to Rosen et al. discloses a multi-purpose toothbrush.

While these devices fulfill their respective, particular objective and requirements, the aforementioned patents do not describe a combination toothbrush and tongue brush for allowing a person to brush their teeth and their tongue without gagging.

In this respect, the combination toothbrush and tongue brush according to the present invention substantially departs from the conventional concepts and designs of the prior art, and in doing so provides an apparatus primarily developed for the purpose of allowing a person to brush their teeth and their tongue without gagging.

Therefore, it can be appreciated that there exists a continuing need for new and improved combination toothbrush and tongue brush which can be used for allowing a person to brush their teeth and their tongue without gagging. In this regard, the present invention substantially fulfills this need.

SUMMARY OF THE INVENTION

In the view of the foregoing disadvantages inherent in the known types of toothbrushes now present in the prior art, the present invention provides an improved combination toothbrush and tongue brush. As such, the general purpose of the present invention, which will be described subsequently in greater detail, is to provide a new and improved combination toothbrush and tongue brush and method which has all the advantages of the prior art and none of the disadvantages.

To attain this, the present invention essentially comprises a main body portion having a generally rectangular cross-section. The main body portion has a first end and a second end. A toothbrush portion extends linearly from the first end of the main body portion. The toothbrush portion has a plurality of long bristles extending orthogonally therefrom. The plurality of long bristles are arranged in four rows of ten. A tongue brush portion extends from the second end of the main body portion. The-tongue brush portion includes a curvilinear shaft integrally coupled with the second end of the main body portion. A free end of the curvilinear shaft has an arcuate portion extending therefrom. An interior surface of the arcuate portion has a plurality of short bristles extending outwardly therefrom. The plurality of short bristles each have a length less than ⅓ of a length of the large bristles of the toothbrush portion. The plurality of short bristles are arranged in three rows including a middle row and two end rows. The middle row includes fourteen short bristles and the two end rows each include thirteen short bristles. A plurality of gripping ridges are integrally formed and extend upwardly from an interior surface of the main body portion intermediate the first and second ends thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination toothbrush and tongue brush which has all the advantages of the prior art toothbrushes and none of the disadvantages.

It is another object of the present invention to provide a new and improved combination toothbrush and tongue brush which may be easily and efficiently manufactured and marketed.

It is a further object of the present invention to provide a new and improved combination toothbrush and tongue brush which is of durable and reliable construction.

An even further object of the present invention is to provide a new and improved combination toothbrush and tongue brush which is susceptible of a low cost of manufacture with regard to both materials and labor, and which accordingly is then susceptible of low prices of sale to the consuming public, thereby making such a combination toothbrush and tongue brush economically available to the buying public.

Even still another object of the present invention is to provide a new and improved combination toothbrush and tongue brush for allowing a person to brush their teeth and their tongue without gagging.

Lastly, it is an object of the present invention to provide a new and improved combination toothbrush and tongue brush including a main body portion. A toothbrush portion extends linearly from a first end of the main body portion. The toothbrush portion has a plurality of long bristles extending orthogonally therefrom. A tongue brush portion extends from a second end of the main body portion. The tongue brush portion has a plurality of short bristles extending outwardly therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
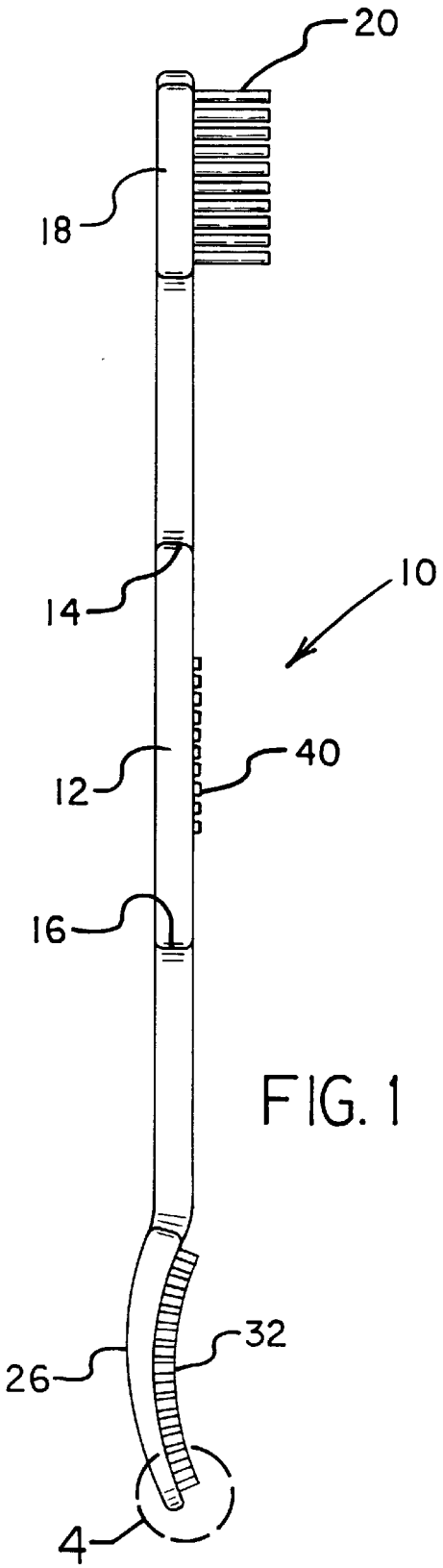
FIG. 1 is a side view of the preferred embodiment of the combination toothbrush and tongue brush constructed in accordance with the principles of the present invention.
Figure 2:
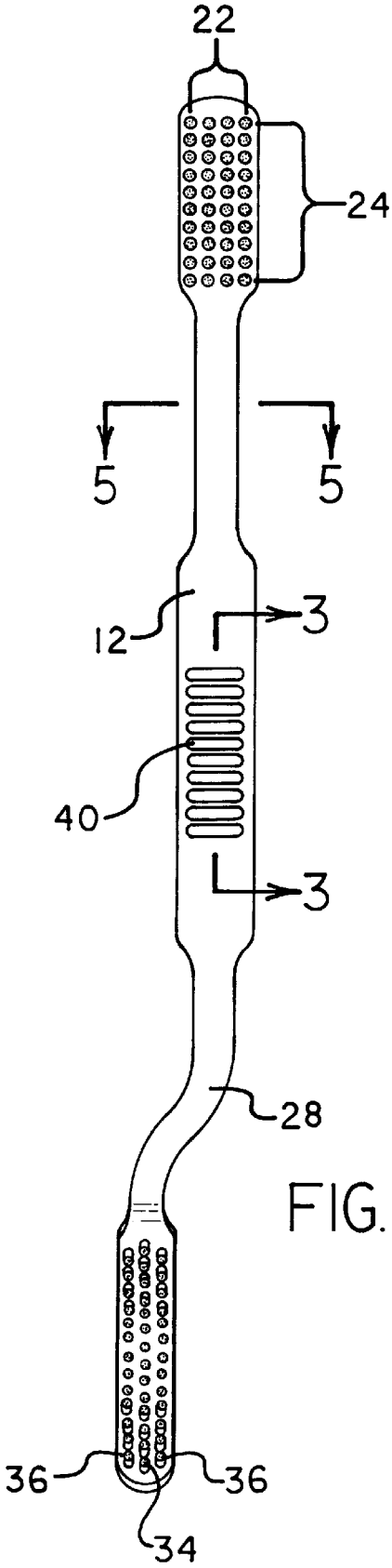
FIG. 2 is a top plan of the present invention.
Figure 3:
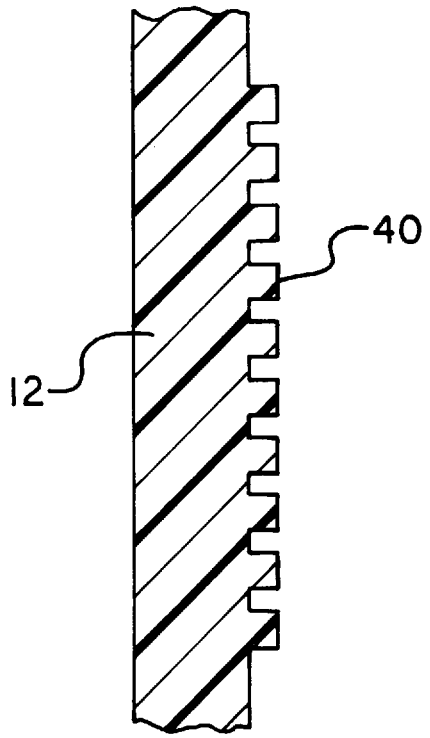
FIG. 3 is a cross-sectional view as taken along line 3—3 of FIG. 2.
Figure 4:
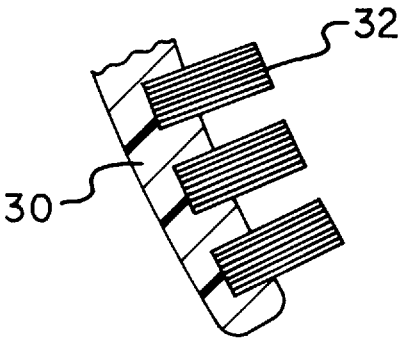
FIG. 4 is a side view of the bristles of the tongue brush as taken from circle 4 of FIG. 1.
Figure 5:
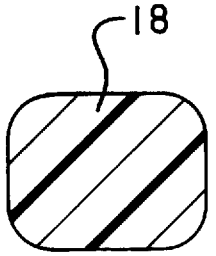
FIG. 5 is a cross-sectional view as taken along line 5—5 of FIG. 2.

With reference now to the drawings, and in particular, to FIGS. 1 through 5 thereof, the preferred embodiment of the new and improved combination toothbrush and tongue brush embodying the principles and concepts of the present invention and generally designated by the reference number 10 will be described.

Specifically, it will be noted in the various Figures that the device relates to a combination toothbrush and tongue brush for allowing a person to brush their teeth and their tongue without gagging. In its broadest context, the device consists of a main body portion, a toothbrush portion, a tongue brush portion and a plurality of gripping ridges. Such components are individually configured and correlated with respect to each other so as to attain the desired objective.

The main body portion 12 has a generally rectangular cross-section. Note FIG. 5. The main body portion 12 has a first end 14 and a second end 16. The main body portion 12 is preferably fabricated of a rigid plastic material known in the toothbrush art.

The toothbrush portion 18 extends linearly from the first end 14 of the main body portion 12. The toothbrush portion 18 has a plurality of long bristles 20 extending orthogonally therefrom. The plurality of long bristles 20 are arranged in four rows 22 of ten 24. The toothbrush portion 18 is configured similar to that of toothbrushes known in the art.

The tongue brush portion 26 extends from the second end 16 of the main body portion 12. The tongue brush portion 26 includes a curvilinear shaft 28 integrally coupled with the second end 16 of the main body portion 12. Note FIG. 2. A free end of the curvilinear shaft 28 has an arcuate portion 30 extending therefrom. An interior surface of the arcuate portion 30 has a plurality of short bristles 32 extending outwardly therefrom. The plurality of short bristles 32 each have a length less than ⅓ of a length of the large bristles 20 of the toothbrush portion 18. The plurality of short bristles 32 are arranged in three rows including a middle row 34 and two end rows 36. The middle row 34 includes fourteen short bristles and the two end rows 36 each include thirteen short bristles. The shape of the arcuate portion 30 allows for the user to properly brush their tongue without the gagging that normally occurs when brushing the tongue with the normal toothbrush. Note FIG. 4. The short bristles 32 are ideal in that they are only required to contact the surface of the tongue, unlike bristles of a toothbrush, which are longer in order to accommodate the grooves and spaces associated with a set of teeth.

The plurality of gripping ridges 40 are integrally formed and extend upwardly from an exterior surface of the main body portion 12 intermediate the first and second ends thereof. Note FIG. 3. The gripping ridges 40 serve to preclude the instrument from falling out of the user's hand while in use due to wet and slippery conditions consistent with dental care.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination tooth brush and tongue brush for allowing a person to brush their teeth and their tongue without gagging comprising, in combination:

an elongated main body portion having a generally rectangular transverse cross-section, the main body portion having a first end and a second end and defining first and second longitudinally extending planes orthogonal to one another;

a tooth brush portion extending linearly from the first end of the main body portion, the toothbrush portion having a plurality of long bristles extending orthgonally therefrom, the plurality of long bristles being arranged in four rows of ten;

a tongue brush portion extending from the second end of the main body portion, the tongue brush portion including a curvilinear shaft integrally coupled with the second end of the main body portion, the curvilinear shaft curving within said first plane to a free end, the free end of the curvilinear shaft having an arcuate portion extending therefrom, said arcuate portion extending out of said first plane within a third plane parallel to said second plane, said arcuate portion spaced from said second plane, an interior, concave, surface of the arcuate portion having a plurality of short bristles extending outwardly therefrom, the plurality of short bristles each having a length less than ⅓ of a length of the large bristles of the tooth brush portion, the plurality of short bristles being arranged in three rows including a middle row and two end rows, the middle row including foruteen short bristles and the two end rows each including thirteen short bristles; and a plurality of gripping ridges integrally formed and extending upwardly from an exterior surface of the main body portion intermediate the first and second ends thereof.

* * * * *